US010204491B2

(12) United States Patent
Idris et al.

(10) Patent No.: US 10,204,491 B2
(45) Date of Patent: Feb. 12, 2019

(54) HYBRID MECHANICAL AND VIDEO SLOT MACHINE APPARATUS AND METHODS

(71) Applicant: IGT CANADA SOLUTIONS ULC, Moncton (CA)

(72) Inventors: Fayez Idris, Dieppe (CA); Donovan Francis, Riverview (CA); Jonathan Lajoie, Moncton (CA); Wayne Forsey, Riverview (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 975 days.

(21) Appl. No.: 14/148,263

(22) Filed: Jan. 6, 2014

(65) Prior Publication Data

US 2015/0194021 A1 Jul. 9, 2015

(51) Int. Cl.
*G07F 17/32* (2006.01)
*G07F 17/34* (2006.01)

(52) U.S. Cl.
CPC ..... *G07F 17/34* (2013.01); *G07F 17/3213* (2013.01)

(58) Field of Classification Search
CPC ..... G07F 17/3202; G07F 17/3211; G07F 17/3213; G07F 17/34
See application file for complete search history.

(56) References Cited

U.S. PATENT DOCUMENTS 820,021 A * 5/1906 Smith ..... C14B 1/00 241/178
2,481,708 A * 9/1949 Adams ..... G03B 21/32 242/329.1
3,831,198 A * 8/1974 Kihara ..... G11B 15/6655 360/130.23
4,050,650 A * 9/1977 Wadleigh ..... G06K 17/0019 226/110
4,138,114 A * 2/1979 Andersen ..... G07F 17/34 250/557
4,754,658 A * 7/1988 Gutknecht ..... G07F 17/3213 273/143 R
5,262,826 A * 11/1993 Hediger ..... G03G 15/757 399/162
5,284,344 A * 2/1994 Howard ..... G07F 17/3213 273/142 R
5,524,850 A * 6/1996 Liao ..... B65H 75/22 242/608.5

(Continued)

FOREIGN PATENT DOCUMENTS

JP 2008-272106 * 11/2008 ..... A63F 5/04

OTHER PUBLICATIONS

English Translation of JP 2008-272106.*

(Continued)

*Primary Examiner* — Steven J Hylinski
(74) *Attorney, Agent, or Firm* — Sage Patent Group

(57) ABSTRACT

Apparatus and methods for simulating the appearance of a plurality of slot machine reels are provided including a plurality of mechanical cylinders which rotate around a plurality of video displays. The video displays show graphics or video of spinning slot machine reel images and the mechanical cylinders rotate around the video display in coordinated speed with the graphics or video to give the appearance of mechanical slot machine reels.

14 Claims, 10 Drawing Sheets

(56) References Cited

U.S. PATENT DOCUMENTS 5,537,266 A * 7/1996 Yamashita ..... G11B 15/6655 360/85
5,769,347 A * 6/1998 Kikuchi ..... G11B 23/08778 242/347
6,096,389 A * 8/2000 Kanai ..... C23C 16/511 118/723 MR
6,131,840 A * 10/2000 Ukai ..... G03B 1/04 242/324
7,452,276 B2 * 11/2008 Loose ..... G07F 17/3213 463/20
7,458,890 B2 12/2008 Loose et al.
7,654,899 B2 2/2010 Durham et al.
8,246,440 B2 8/2012 Stewart
8,262,457 B2 9/2012 Ansari et al.
8,663,009 B1 3/2014 Pacey et al.
9,064,372 B2 * 6/2015 Rasmussen ..... G07F 17/3211
2001/0025898 A1 * 10/2001 Arrane ..... G09B 29/06 242/538.2
2004/0051948 A1 * 3/2004 Reed ..... B29C 43/222 359/529
2004/0063558 A1 * 4/2004 Delisle ..... B31B 19/90 493/394
2004/0065742 A1 * 4/2004 Satou ..... B65H 29/006 235/475
2004/0251625 A1 * 12/2004 Okada ..... G07F 17/3202 273/143 R
2004/0266515 A1 12/2004 Gauselmann
2005/0109373 A1 * 5/2005 Brown ..... H01L 21/67057 134/6
2005/0140088 A1 * 6/2005 Randall ..... G07F 17/3213 273/143 R
2007/0054723 A1 3/2007 Mattice et al.
2008/0004104 A1 * 1/2008 Durham ..... G07F 17/3202 463/20
2008/0108422 A1 * 5/2008 Hedrick ..... G07F 17/34 463/22
2008/0150179 A1 * 6/2008 Johnson ..... B29D 11/00269 264/2.1
2009/0075721 A1 * 3/2009 Pacey ..... G07F 17/3211 463/20
2009/0126561 A1 * 5/2009 Becker ..... F04B 1/2085 92/70
2009/0176550 A1 * 7/2009 Cove ..... G07F 17/3213 463/20
2009/0227353 A1 9/2009 Yoshizawa
2009/0227370 A1 9/2009 Stewart
2010/0298049 A1 * 11/2010 Ansari ..... G07F 17/3211 463/30
2012/0061504 A1 * 3/2012 Powell ..... B65H 49/24 242/564
2012/0178521 A1 * 7/2012 Kim ..... G07F 17/3213 463/20
2014/0020627 A1 * 1/2014 Kano ..... C23C 16/45551 118/719

OTHER PUBLICATIONS

International Search Report in PCT/CA2014/050327; dated Sep. 9, 2014; Application Filed Apr. 2, 2014.
International Preliminary Report on Patentability Corresponding to International Application No. PCT/CA2014/050327; dated Jul. 21, 2016; 7 Pages.

* cited by examiner

HYBRID MECHANICAL AND VIDEO SLOT MACHINE APPARATUS AND METHODS

BACKGROUND

Historically, traditional mechanical slot machines included physical slot machine reels with a number of images permanently applied to each reel, for instance, twenty two images on each reel. In these machines, each image serves as a potential stopping point for the machine reel, allowing a player to determine whether he or she has won a prize. More recently, video slot machines have become popular, with an electronic display for the reels that may have any number of different images, thus affording the game designer and operator greater flexibility in the presentation of the game to the player. Further, the electronic display allows the game operator to change the appearance and the number of images on each reel.

SUMMARY

Disclosed herein is a hybrid device and related methods that combines various features of a video slot machine and a purely mechanical slot machine.

In one embodiment, a gaming machine configured to provide a wagering game is provided. The gaming machine provides a payout based on a wager and the results of the game and the gaming machine includes a plurality of mechanical reels configured for use in presenting the appearance of a traditional mechanical slot machine reel to a player. Each of the plurality of mechanical reels is defined by circular hoops which are disposed adjacent to one another and a transparent curved outer surface for each mechanical reel is defined by a rectangular strip disposed in a circular position between the adjacent circular hoops. Each mechanical reel is then rotatably positioned by a plurality of mounts and each of the mounts is disposed to support at least one of the mechanical reels.

In one embodiment, the mounts are rollers that are independent to each mechanical reel. In an alternative embodiment, rods may span the length of the assembly and mounts, which may include rollers, may be rotatably mounted to the rods in appropriate positions along the rods so as to support the mechanical reels. In yet another embodiment, the mechanical reels may be supported by a combination of rollers that are independent to each mechanical reel and rotatable mounts provided on rods spanning the length of the assembly. The actual number of rollers and/or mounts required may vary, but preferably a sufficient number are provided to ensure stable positioning and rotation of each mechanical reel. In one embodiment, external rollers may be used as clamps towards maintaining rigidity for the assembly. Such external rollers may be supported by being mounted to the plates adjacent to and on the sides of each mechanical reel, or the external rollers may be attached to one or more of the internal rollers, by a plate, clamp, or spring assembly. Alternatively, or additionally, the primary supporting rollers may be the external rollers and the internal rollers may be used as clamps for support and mounted by a suitable plate, clamp, or spring assembly.

Each mechanical reel has an individual drive mechanism configured to independently control the rotation of the mechanical reel separate from the rotation of the other mechanical reels. Preferably the drive mechanism is controlled with a computer processor. In one embodiment the drive mechanism may be a stepper motor. The plurality of mounts, either alone or in conjunction with the drive mechanism, serve to rotatably support the mechanical reel holding it in position so that the mechanical reel can rotate about an imaginary axis extending through the middle of the mechanical reel. The plurality of mounts are positioned either inside or outside or both inside and outside of the mechanical reel in a way that each mount touches the mechanical reel and thereby serves to maintain the position of the mechanical reel.

Thus, the configuration provides a mechanical reel that is mounted or held in position at its periphery, rather than being mounted on a central axis with radial connection to the edge of the reel, as is the case with a traditional slot machine reel or, for instance, a bicycle wheel. Thus, in one embodiment, the mechanical reels contemplated herein preferentially do not have spokes and are not affixed about a central axis. This configuration for the mechanical reel avoids mechanical or electric hardware taking up significant space in the interior space the mechanical reel, allowing for an electronic video display, such as a liquid crystal display (LCD) or organic light-emitting diode display (OLED) and associated electronics, to be fixedly installed within the mechanical reel, that is, in an immobile, non-rotating position inside the mechanical reel.

In one embodiment, the gaming machine includes a plurality of electronic video displays, for instance LCD or OLED displays, one for each of the mechanical reels. Preferably, one video display is provided for each mechanical reel. Each electronic video display has a convex curved display surface for presenting a visual image, for instance a visual simulation of a traditional mechanical spinning slot machine reel that shows a number of symbols. For instance, the visual simulation may be provided in the form of vertically scrolling slot machine symbols. In one embodiment, one electronic video display is fixedly mounted internally and individually within each mechanical reel so that each mechanical reel rotates around its own dedicated, that is, specific to that mechanical reel, and fixedly mounted video display and the convex curved display surface of the video display is adjacent to and underneath the curved transparent surface of the mechanical reel. In this way, a player can see the video images appearing on the curved video display, through the curved transparent surface of the mechanical reel.

In another embodiment, a single video display is used for an entire group of mechanical reels and the single video display provides, from the perspective of the game player, a plurality of images, preferably one image for each mechanical reel. From the perspective of the video display, the plurality of images may be a single image with real or virtual frames that effectively, that is, visually, provide different images or series of images within each mechanical reel.

In another embodiment a single mechanical reel is provided and a series of images representing the turning mechanical reels of a traditional slot machine are shown by either a single or a plurality of video displays.

In one embodiment, the curved display surface of the video display is not concentric to the curved surface of the mechanical reel. This causes the distance between the reel and the screen to vary slightly, but allow the reels to be closer to the display at the peak of the curve of the screen.

The gaming machine also includes a controller configured to synchronize the drive mechanisms and the rotation of each mechanical reel with the images presented on the respective video display mounted within that mechanical reel so that the images shown on the video display appear to move in sync with the rotation of the mechanical reel. This synchronization of the mechanical reel with the images presented on the video display provides the player the illusion or appearance of a traditional mechanical spinning slot machine reel since the images presented on the video display appear to be synchronized with the rotation of the mechanical reel.

The stepper motor may include a feedback mechanism to communicate to the controller information or data representing the rotational speed of the stepper motor or, alternatively or additionally, the rotational speed of the mechanical reel. Alternatively, or additionally, a separate speedometer may be provided to detect the rotational speed of the mechanical reel. In certain embodiments, the controller is configured to receive information or data representing the rotational speed of the stepper motor or, alternatively or additionally, the rotational speed of the mechanical reel. In certain embodiments the controller is also configured to modify or otherwise adjust the rotational speed of the stepper motor so as to similarly modify or otherwise adjust the rotational speed of the mechanical reel. In one embodiment, the images shown on the video display are configured to provide the appearance of a traditional rotating slot machine reel in a manner that permits, for instance, the stepper motor to slow the rotational speed of the mechanical reel to match the appearance of a slowing rotation for the images on the video display.

In a preferred embodiment the reel starts from a stopped or still position with a rotational speed of zero and the reel is then quickly accelerated to rotate at a relatively high rate of speed. Similarly, the images displayed on the video screen start from a stopped or still position and appear to quickly accelerate to rotate at a relatively high rate of speed. At the relatively high rate of speed the images may move across the screen so quickly that they are difficult or impossible to detect with the human eye. The rotation of the images is then slowed down, for instance, gradually and as the rotation of the images slows, the rotation of the reel is also slowed so that the rotation of the images and the rotation of the mechanical reel appears to match. This continues until the rotation of the images and the reel stops or is stopped.

Thus, in accordance with certain embodiments, the images shown on the video display provide the appearance of a traditional slot machine reel so that in one sequence of steps, the images show a mechanical reel in a stopped position, the mechanical reel being subsequently accelerated to a fast rotational speed and then slowing down to again reach a stopped position. Taking in to account the rotational speed information for the images being shown on the video display, the controller can either increase or decrease the rotational speed of the mechanical reel to match the images being shown on the video display.

Alternatively, the game machine may be provided with a set of a variety of different videos, each video showing the images for a reel in a stopped position, the images being subsequently accelerated to a fast rotational speed and then slowing down to again reach a stopped position. In this embodiment preferably each video is unique so the total elapsed run time or length of the video is different from the others. Further, the final image, that is the last image that is shown to the player as the game result for a particular spin, will preferably vary among the videos within the set. For instance, if the images appearing on the video display are fruits, then the set of different videos might include the following game results: two videos might be cherries; three videos might be bananas; four videos might be oranges, and three videos might be apples. Further, each of the videos may have a different and/or unique total elapsed run time or length. Still further, each of the videos may display different acceleration and deceleration properties for the spinning or rotation of the images.

Accordingly, matching the actual rotation of the mechanical reel to the apparent rotation of the images shown in the videos on the electronic video display requires different acceleration and deceleration properties for each video, as well as different overall rotation times, to match the total elapsed run time or length of the video. Since the acceleration and deceleration properties as well as the total elapsed run time or length of the video for each video are known, these properties can be recorded and assigned a name, code or other identifier, such as a number or letter combination.

During operation the game machine may randomly select a game result and then also select a video to play to display the selected game result. The controller may then determine the name, code or other identifier for the selected video and, based on the known properties of the video relating to the acceleration and deceleration properties as well as the total elapsed run time or length of the video, cause the stepper motor for the identified mechanical reel to rotate to match the properties of the selected video.

Additionally, or alternatively, the video display may be sped up or slowed down to match the rotational speed of the mechanical reel. In one embodiment, the combination of both the video displays and the mechanical reels creates the illusion that a pure mechanical reel is spinning. In part, this illusion may be achieved with the use of graphics or images on the video display that are very close to the graphics or images that are provided on traditional mechanical reels. Additionally, the graphics or images on the video display may be created to exhibit simulated wear and tear, as would be the case, for instance with a use of traditional mechanical reels over time. Further, spinning the mechanical reels on top of the video reels gives an appearance of spinning traditional mechanical reels. The bouncing, wobbling, vibrations and any other movement of traditional mechanical reels may be simulated on the video display. For instance, these effects may be achieved by changing the way the images are scrolled as well as how they are displayed and aligned on the display.

Further, the effects, such as aging, may be changed over time to reflect apparent use, wear and changes in the appearance of simulated mechanical reels. Still further, the mechanical reels may include markings on their transparent curved outer surfaces that simulate the appearance of mechanical reels. The gaming machine may also be configured to simulate the sounds associated with the spinning of traditional mechanical reels.

In an alternative embodiment a single video display is mounted within and used with a plurality of mechanical reels. In this embodiment, image on the video display screen may be divided into a plurality of separate apparent images so that each mechanical reel is provided a separate apparent image. It should be appreciated that the apparent rotation of the separate images shown on the video display can then be matched to the respective mechanical reel in the apparatus.

In another alternative embodiment, a single video display is mounted within and used with a single mechanical reel. In this embodiment, the single mechanical reel is configured to provide the appearance to a player of a plurality of reels.

Other objects, advantages and novel features of the present invention will become apparent from the following detailed description of the invention when considered in conjunction with the accompanying drawings.

BRIEF DESCRIPTION OF THE DRAWINGS

Features and advantages of the present invention will become apparent to those skilled in the art from the following description with reference to the drawings, in which.

DETAILED DESCRIPTION

For simplicity and illustrative purposes, the principles of the present invention are described by referring mainly to various exemplary embodiments thereof. Although the preferred embodiments of the invention are particularly disclosed herein, one of ordinary skill in the art will readily recognize that the same principles are equally applicable to, and can be implemented in other systems, and that any such variation would be within such modifications that do not part from the true spirit and scope of the present invention. Before explaining the disclosed embodiments of the present invention in detail, it is to be understood that the invention is not limited in its application to the details of any particular arrangement shown, since the invention is capable of other embodiments. The terminology used herein is for the purpose of description and not of limitation.

Figure 1:
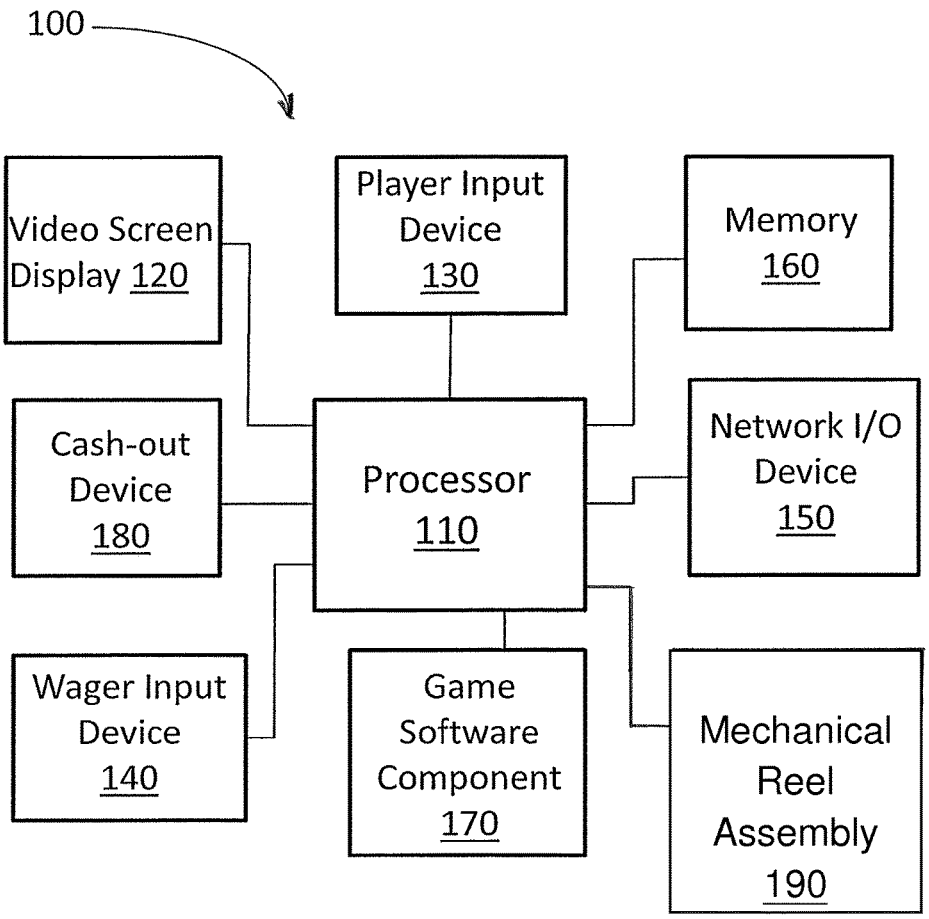
FIG. 1 is a block diagram showing components of a game machine according to one embodiment.

FIG. 1 provides a block diagram of an example game machine, according to an example embodiment of the present invention. Game device 100 may be a terminal in a distributed system. Game device 100 has a processor 110 in communication with several peripherals. Game device 100 includes at least one a video screen display 120. The video screen display 120 may be used to show the operation and results of a round of the slot machine selection game (e.g. show the spinning of the different reels and their stopping position so that a player can see the game being played and the result). There may be an input device 130, which may be any device which allows the gaming device 100 to accept input from the user, for example, a conventional keyboard, a keypad, a joystick, a mouse, a number of buttons, a touch-sensitive display, a slot machine lever or arm, or a combination of the foregoing. The gaming device 100 may also include a wager input device 140. The wager input device 140 may be designed, for example, to accept paper bills, or other slips detailing credit, or may be a device which reads magnetically or electronically stored information. The game device 100 may also include a network I/O device 150. The network I/O device 150 may be, for example, a serial port which may connect to a network or telephone line. Alternatively, the network I/O device 150 may be a wireless communications device. The game device 100 may also include memory 160 to store the various graphics and instructions required to operate video screen display 120. Additionally, there may be a game software component 170 including terminal interface instructions allowing the terminal to interface with a distributed system or network, in conjunction with the network I/O device 150 or separately. A cash-out device 180 may also be provided to either payout winnings directly to a player or to provide a payment slip that the player may exchange for cash or other credits at a cashier.

The processor 110 may control the rotation of one or more motors with a mechanical reel assembly 190. These motors may be, for instance, stepper motors that drive mechanical reels within the mechanical reel assembly 190. In one embodiment software on the processor 110 is configured to cause the processor 110 to coordinate the rotation of the one or more motors within the mechanical reel assembly 190 to the images that are displayed on the respective one or more video screens 120 so that the rotation of the mechanical reels within the mechanical reel assembly 190 appears to be coordinated and synchronized. The mechanical reel assembly 190 may be configured with one or more feedback mechanisms such as an optical, mechanical or other feedback mechanism to provide feedback including data or information on the speed and/or position of the mechanical reel as well as suitable features to communicate this feedback (data or other information) back to the processor 110. It may be appreciated that alternative embodiments may include more components or fewer components as desired or as the specific implementation requires.

Figure 2:
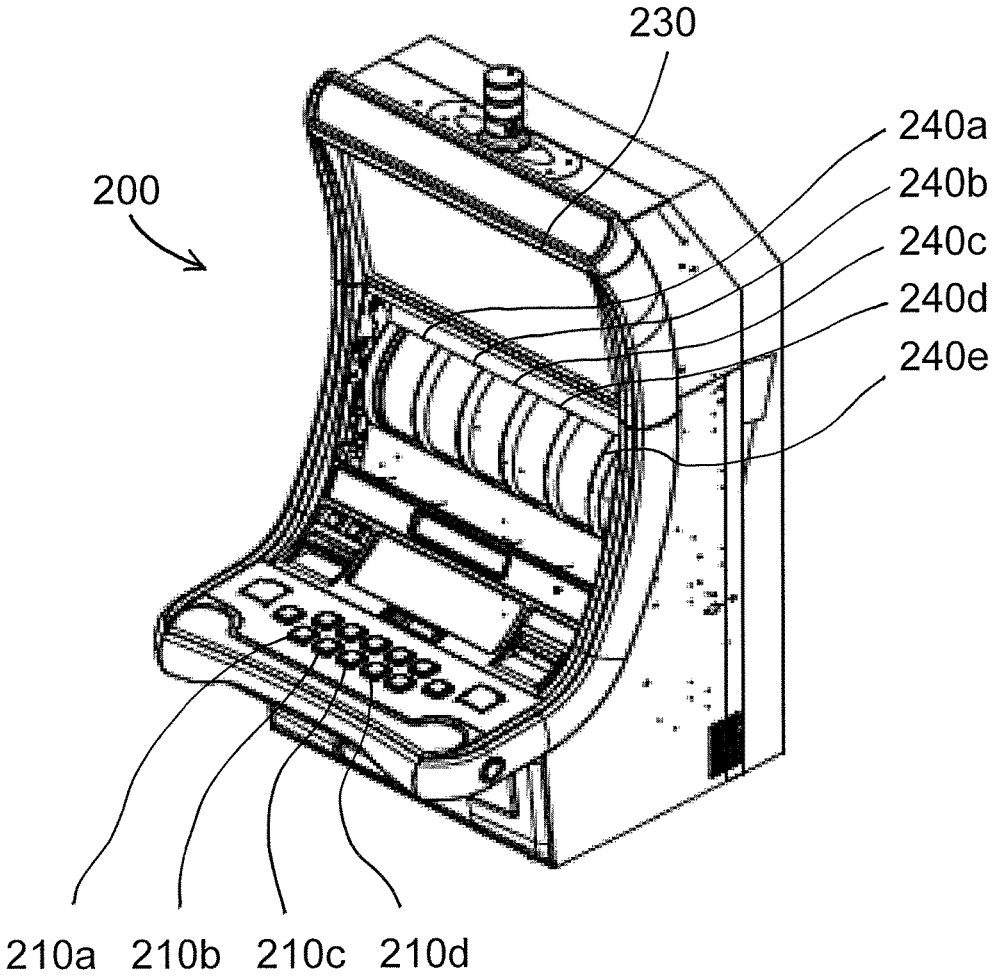
FIG. 2 depicts an exemplary game machine according to an embodiment.

FIG. 2 depicts an exemplary game machine, according to an example embodiment of the present invention.

The gaming machine 200 provides a payout based on a wager and the results of the game and the gaming machine includes a plurality of mechanical reels 240*a-e* configured for use in presenting the game player with the appearance of a set of traditional mechanical slot machine reels.

The game machine 200 also includes a collection of input buttons 210*a-d* (for instance) and may also include a slot machine lever or arm (not shown). An upright display 230 is provided and may be used to provide game identification and other game related information such as paytables, jackpot amounts, recent winnings, game logos or other advertising or information as desired by the game owner or operator. A number of slot machine reels 240 are provided on the front of the machine so that they are visible to the player. Aside from the slot machine reels 240*a-e*, the assembly (not shown) that houses and operates the slot machine reels is not visible from outside the game machine 200.

Figure 3:
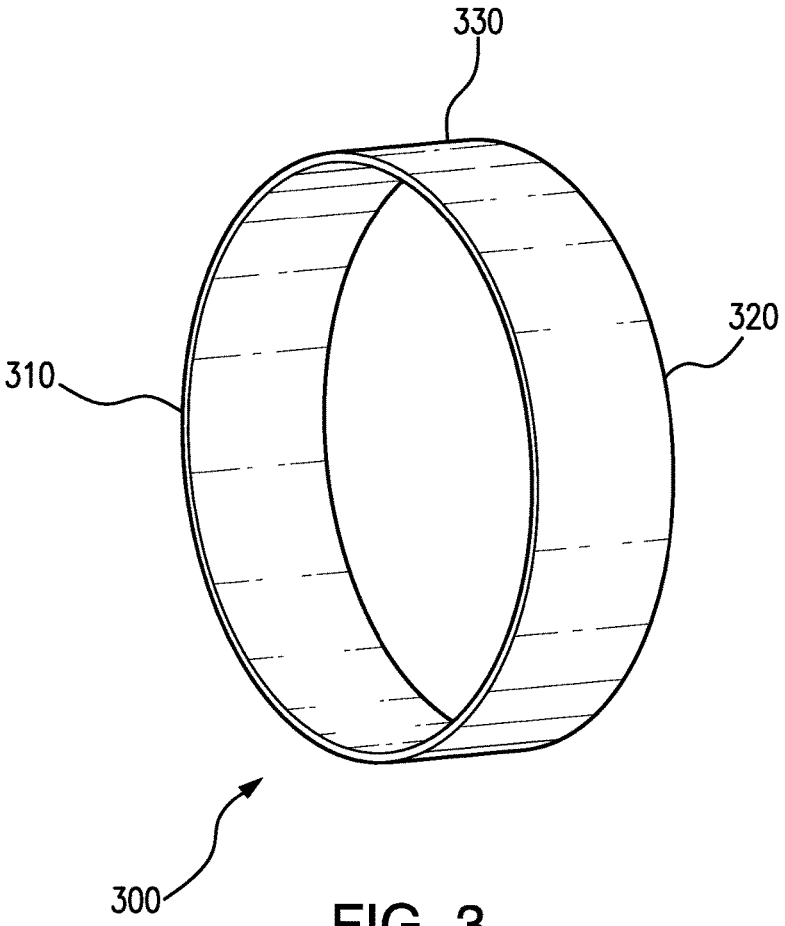
FIG. 3 depicts a perspective view of an exemplary mechanical reel in accordance with certain embodiments.

FIG. 3 depicts a perspective view of an exemplary mechanical reel 300 in accordance with certain embodiments of the invention. In practice, a plurality of mechanical reels 300 are provided, although some embodiments may utilize a single mechanic reel 300. Each mechanical reel 300 includes a pair of circular hoops 310 and 320 which are disposed adjacent to and spaced apart from one another. These circular hoops 310 and 320 may be fashioned from any suitable material, including plastic, metal, resin or other common materials having suitable characteristics of stiffness and rigidity when formed. A continuous transparent curved outer surface 330 for each mechanical reel 300 is defined by a rectangular strip disposed in a circular position between the adjacent circular hoops 310 and 320 and effectively spacing the circular hoops 310 and 320 apart. Alternatively the curved outer surface 330 may be formed of a continuous circular shaped strip of transparent material.

Preferably the strip may be formed of a transparent or near transparent plastic. Alternatively, the strip may be translucent or shaded, tinted or colored or it might have certain symbols and markings printed, embossed or otherwise provided on its surface so as to create the illusion of a mechanical reel.

The mechanical reel 300 can be fully transparent or only the strip forming the outer surface 330 may be fully transparent. The strip may include game symbols or elements (not shown) which are physically drawn on or printed to be visible on the outer surface 330. The game symbols or elements can be used to affect or modify game outcomes, for instance, depending on their stop positions. For example, win multiplier or wild symbols may be provided on the strip and alter the outcome presented by the video elements of a display appearing from within the mechanical reel 300.

Further, the game symbols or elements may be static or dynamically rendered. For example dynamic rendering would include the use of epaper display technology which, in one embodiment, might be transparent in a majority of the surface while images, game symbols or other elements could be programmed to appear in other areas. Suitable epaper display technology may include electrophoretic, electrowetting electrofluidic displays or other electronic ink technologies.

Figure 4:
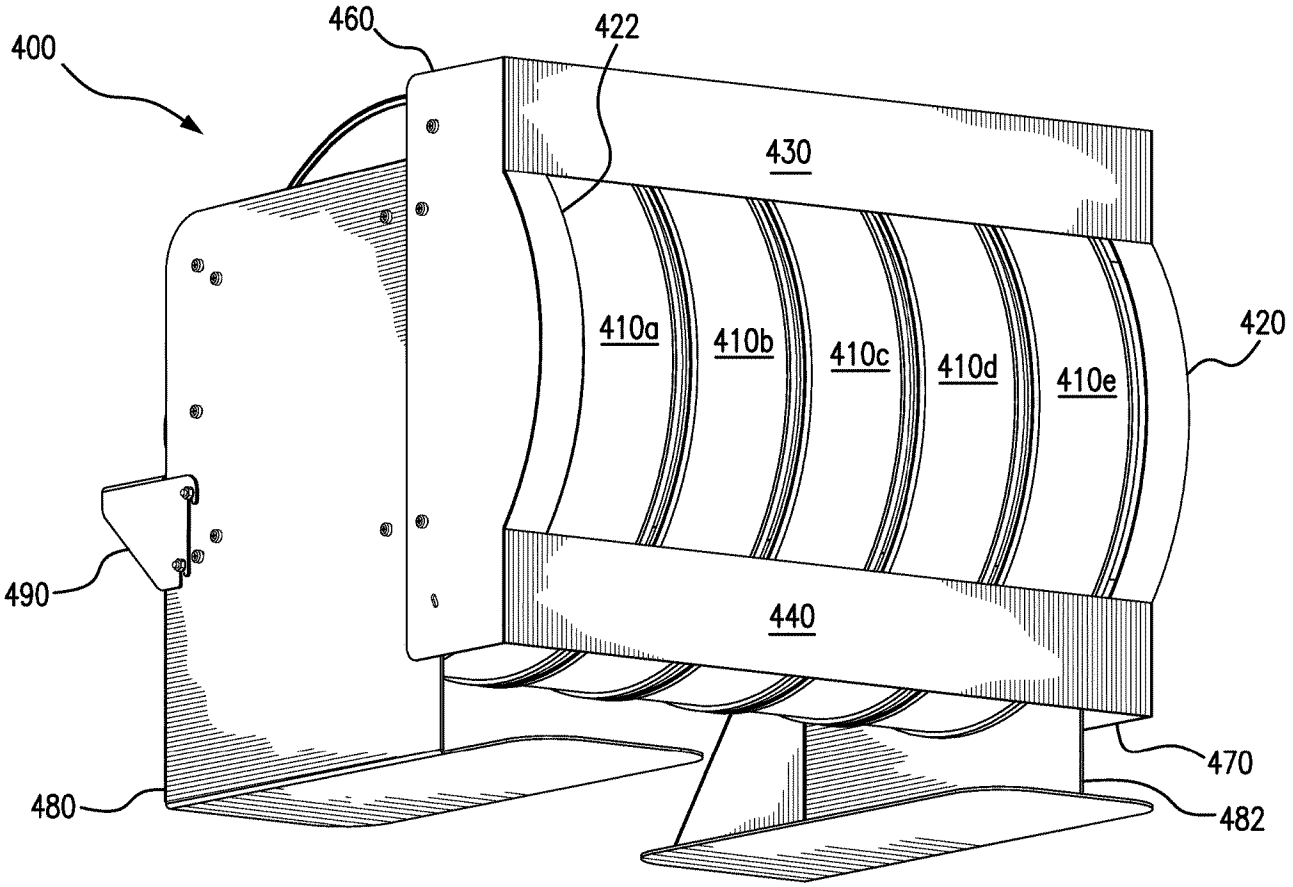
FIG. 4 depicts a perspective view of an assembly of mechanical reels in accordance with certain embodiments.

FIG. 4 depicts a perspective view of an assembly 400 of mechanical reels in accordance with certain embodiments of the invention. The assembly 400 includes five mechanical reels 410*a*-410*e* positioned laterally adjacent to one another so that a portion of the curved outer surface of each mechanical reel is visible through a frame provided as part of the assembly. Although the depicted embodiment shows five mechanical reels 410*a*-410*e*, it should be appreciated and any number of mechanical reels may be provided. In one additional preferred embodiment, three mechanical reels are provided. Any suitable frame arrangement may be provided. In the particular embodiment shown, the frame is composed of a plurality of connected panels including an upper cross member 430 and a lower cross member 440. A pair of curved panels 420 and 422 are attached between the upper cross member 430 and the lower cross member 440. The curved panels 420 and 422 are shaped to generally follow the curved shape of the mechanical reels 410*a*-410*e* and are mounted laterally along the sides of the set of mechanical reels 410*a*-410*e*. Accordingly, in the embodiment depicted in FIG. 4, a portion of the circular hoops and curved outer surface of each of the mechanical reels 410*a*-410*e* is visible from the front. A pair of lateral supports 460 and 470 may also be provided as part of the frame and provide mounting support for some internal components (not shown) of the assembly 400. Support panels 480 and 482 are also provided, each including an upright portion upon which the lateral supports 460 and 470 of the frame may be mounted, along with the internal components (not shown) for the assembly. A portion of a support brace 490 is visible from this perspective and is shown mounted to a back edge of support panel 480.

Alternatively, the assembly may be fashioned from a fewer or additional panels or supports.

Figure 5:
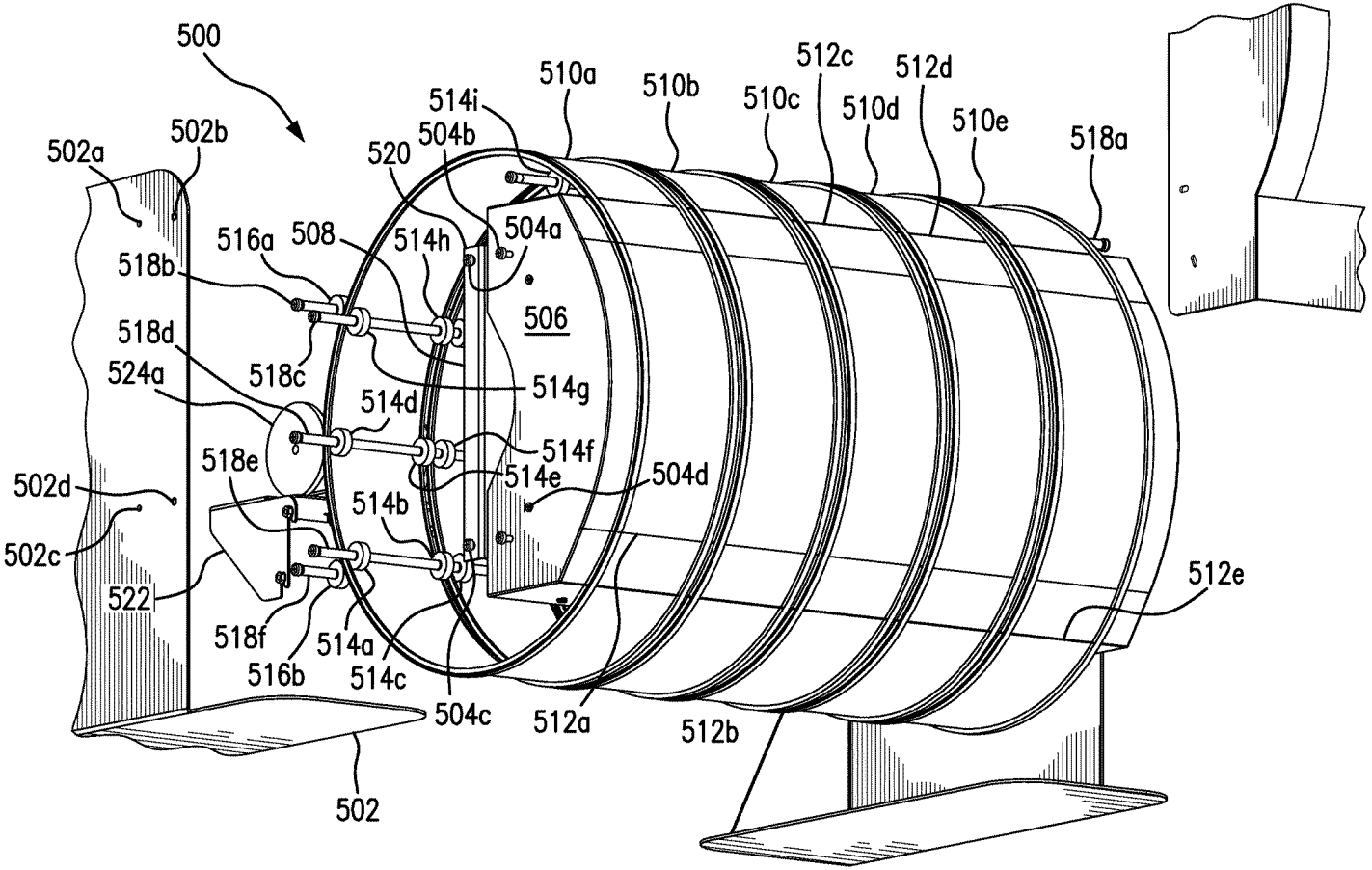
FIG. 5 depicts a perspective view of an embodiment of an assembly similar to that shown in FIG. 4.
Figure 6:
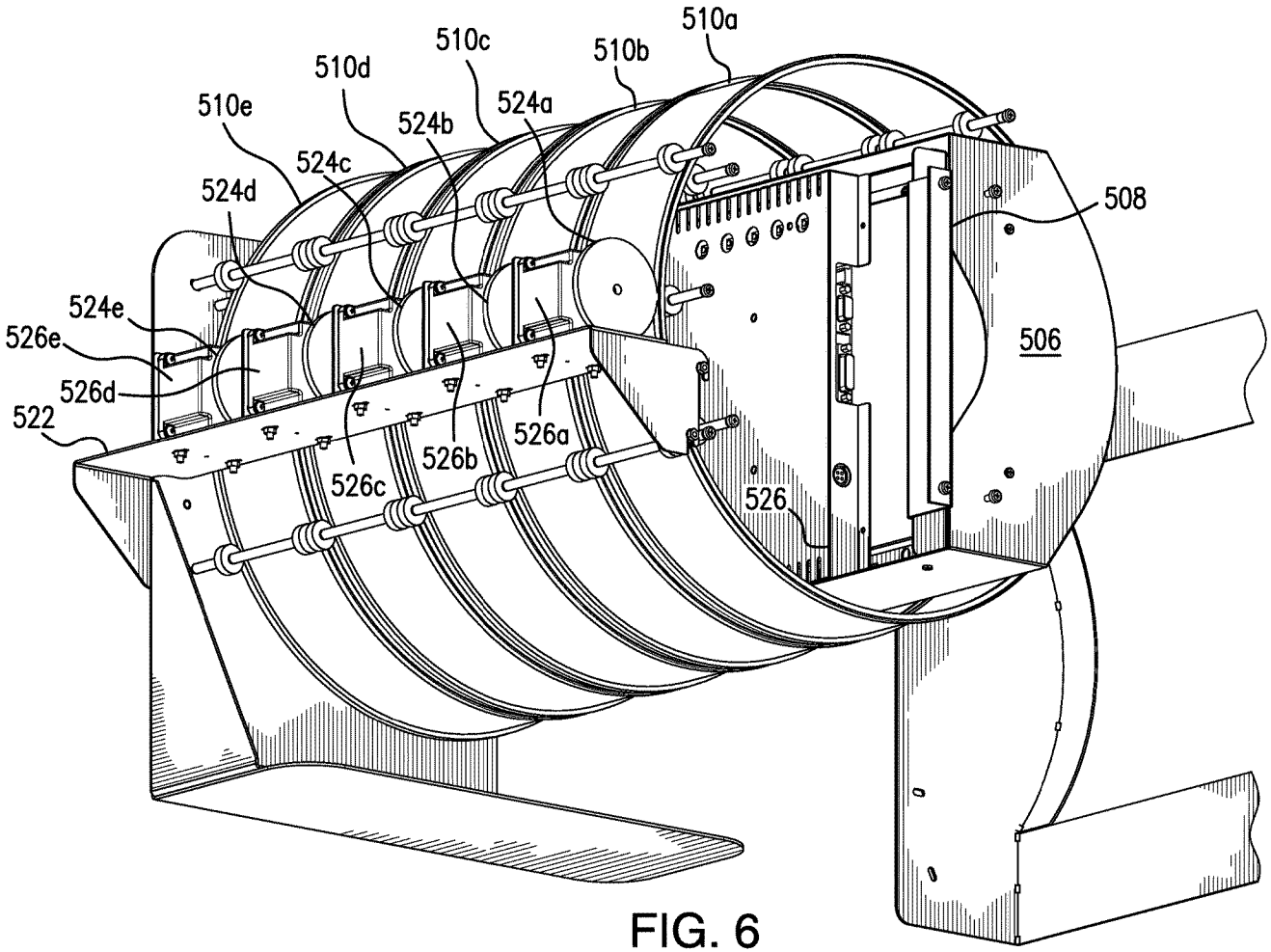
FIG. 6 depicts a perspective view of an embodiment of an assembly similar to that shown in FIG. 4.

FIGS. 5 and 6 depict perspective views of an assembly 500 similar to that shown in FIG. 4, with portions of the frame and one of the support panels removed to show certain internal components within the assembly 500. Support panel 502 is similar to support panel 480 of FIG. 4 however in the view shown in FIG. 5, support panel 502 is detached from the assembly. Support panel 502 includes mounting holes 502*a*, 502*b*, 502*c*, and 502*d* which are positioned on the support panel to engage mounts 504*a*, 504*b*, 504*c*, and 504*d*, respectively. A housing 506 is provided within mechanical reels 510*a*, 510*b*, 510*c*, 510*d*, 510*e* to house electronics (not shown). The housing 506 also includes mounts 504*b* and 504*d*, while mounts 504*a* and 504*c* are provided on housing bracket 520. The electronics (not shown) within the mechanical reels 510*a*, 510*b*, 510*c*, 510*d*, 510*e* are configured to cause the electronic displays 512*a*, 512*b*, 512*c*, 512*d*, 512*e* to shown a variety of images or video. The electronic displays 512*a*, 512*b*, 512*c*, 512*d*, 512*e* may be liquid crystal display (LCD) or organic light-emitting diode display (OLED), e-paper or any other suitable electronic visual display apparatus for providing a video display. Preferably, the electronic displays 512*a*, 512*b*, 512*c*, 512*d*, and 512*e* are curved to generally match the curved outer surface of the mechanical reels 510*a*, 510*b*, 510*c*, 510*d*, and 510*e* so that, in this configuration, the curved outer surface of the mechanical reels 510*a*, 510*b*, 510*c*, 510*d*, and 510*e* is adjacent to and at a close distance to the respective electronic display 512*a*, 512*b*, 512*c*, 512*d*, and 512*e*. In this context, close distance should be understood to mean within 0.5 inches, preferably within 0.3 inches and even more preferably within 0.2 inches and most preferably within 0.1 inches.

In an alternative embodiment (not shown), a single electronic display is provided and mounted within mechanical reels 510*a*, 510*b*, 510*c*, 510*d*, and 510*e*. In this configuration the single electronic display is of sufficient width to span the breadth of the set of mechanical reels 510*a*, 510*b*, 510*c*, 510*d*, and 510*e*. Preferably a plurality of images or videos are provided on the single electronic display, one for each of the mechanical reels 510*a*, 510*b*, 510*c*, 510*d*, and 510*e*.

In either the embodiment with a single electronic display or the embodiment with a plurality of electronic displays 512*a*, 512*b*, 512*c*, 512*d*, and 512*e*, as shown in FIG. 5, noted previously, any different number of mechanical reels might be employed, and a similar or different number of electronic displays might be employed.

Also shown in FIG. 5 are a plurality of mounts including internal mounts 514*a*-514*i* as well as external mounts 516*a* and 516*b*. The internal mounts 514*a*-514*i* and external mounts 516*a* and 516*b* are configured and positioned to rotatably mount the mechanical reel 510*a*. A plurality of other internal and external mounts are similarly positioned with respect to each mechanical reel 510*b*, 510*c*, 510*d*, and 510*e* so that the mechanical reels 510*a*, 510*b*, 510*c*, 510*d*, and 510*e* are able to rotate about a common central axis extending linearly through the middle of the set of mechanical reels 510*a*, 510*b*, 510*c*, 510*d*, and 510*e*. In a preferred embodiment this common central axis is imaginary, as there is no mounting rod or other hardware present at this common central axis. Instead, a series of mounting rods 518*a*, 518*b*, 518*c*, 518*d*, 518*e*, and 518*f* extend along separate axes that extend in parallel with the common central axis. As shown in FIG. 5, mounting rods 518*a*, 518*c*, 518*d* and 518*e* are mounted internally to the set of mechanical reels 510*a*, 510*b*, 510*c*, 510*d*, and 510*e*. FIG. 5 also shows mounting rods 518*b* and 518*f* mounted externally, outside of the set of mechanical reels 510*a*, 510*b*, 510*c*, 510*d*, and 510*e*.

Mounting rods 518*a*, 518*c*, 518*d* and 518*e* extend across the width of the assembly, as shown for mounting rod 518*a*. As can be appreciated from FIGS. 4 and 5 together, mounting rod 518*a* extends between and is mounted to lateral support 460 and lateral support 470. Similarly, the other mounting rods 518*b*, 518*c*, 518*d*, 518*e*, and 518*f* would also extend between and be mounted to support panels 480 and 482. In this way a plurality of rotatable mounts such as internal mounts 514*a*-514*i* and external mounts 516*a* and 516*b* may be mounted on the mounting rods 518*a*, 518*b*, 518*c*, 518*d*, 518*e*, and 518*f* and rotate on the same axis as the respective mounting rod upon which they are provided. Each of the mechanical reels 510*a*, 510*b*, 510*c*, 510*d*, and 510*e* is provided with a set of these rotatable mounts which provide rotatable support for the respective mechanical reel.

Each of the internal mounts 514*a*-514*i* and external mounts 516*a* and 516*b* are rotatably mounted to the respective mounting rod 518*a*, 518*b*, 518*c*, 518*d*, 518*e*, or 518*f*. Accordingly, the internal mounts 514*a*-514*i* and external mounts 516*a* and 516*b* may be provided in the form of cylindrical roller bearings, idle rollers or other suitable rollers capable of touching and rotating in conjunction with the rotation of the mechanical reels 510*a*, 510*b*, 510*c*, 510*d*, and 510*e*.

In a preferred embodiment, the set of mechanical reels 510*a*, 510*b*, 510*c*, 510*d*, and 510*e* are independently mounted so that each mechanical reel can rotate independently of the other mechanical reels.

FIG. 5 also shows support brace 522 from this perspective and drive wheel 524*a* is mounted to drive motor (not shown) that is mounted on the support brace 522. FIG. 6 shows each of the drive motors 526*a*, 526*b*, 526*c*, 526*d*, and 526*e* that rotate drive wheels 524*a*, 524*b*, 524*c*, 524*d*, and 524*e*, respectively. As shown in FIG. 6, the drive motors 526*a*, 526*b*, 526*c*, 526*d*, and 526*e* are mounted on top of support brace 522 in a position so that each drive wheel 524*a*, 524*b*, 524*c*, 524*d*, and 524*e* engages the respective mechanical reel 510*a*, 510*b*, 510*c*, 510*d*, and 510*e*. In a preferred embodiment the drive motors 526*a*, 526*b*, 526*c*, 526*d*, and 526*e* are stepper motors where the rotational speed of the drive motor can be controlled, for instance with a processor.

An additional housing for electronics 526 that supports and operates the electronic displays is also visible in FIG. 6. As shown in the drawing, the additional housing for electronics 526 may include communications connections such as plug in connections to allow the assembly to send and receive electronic data and other communications.

Figure 7:
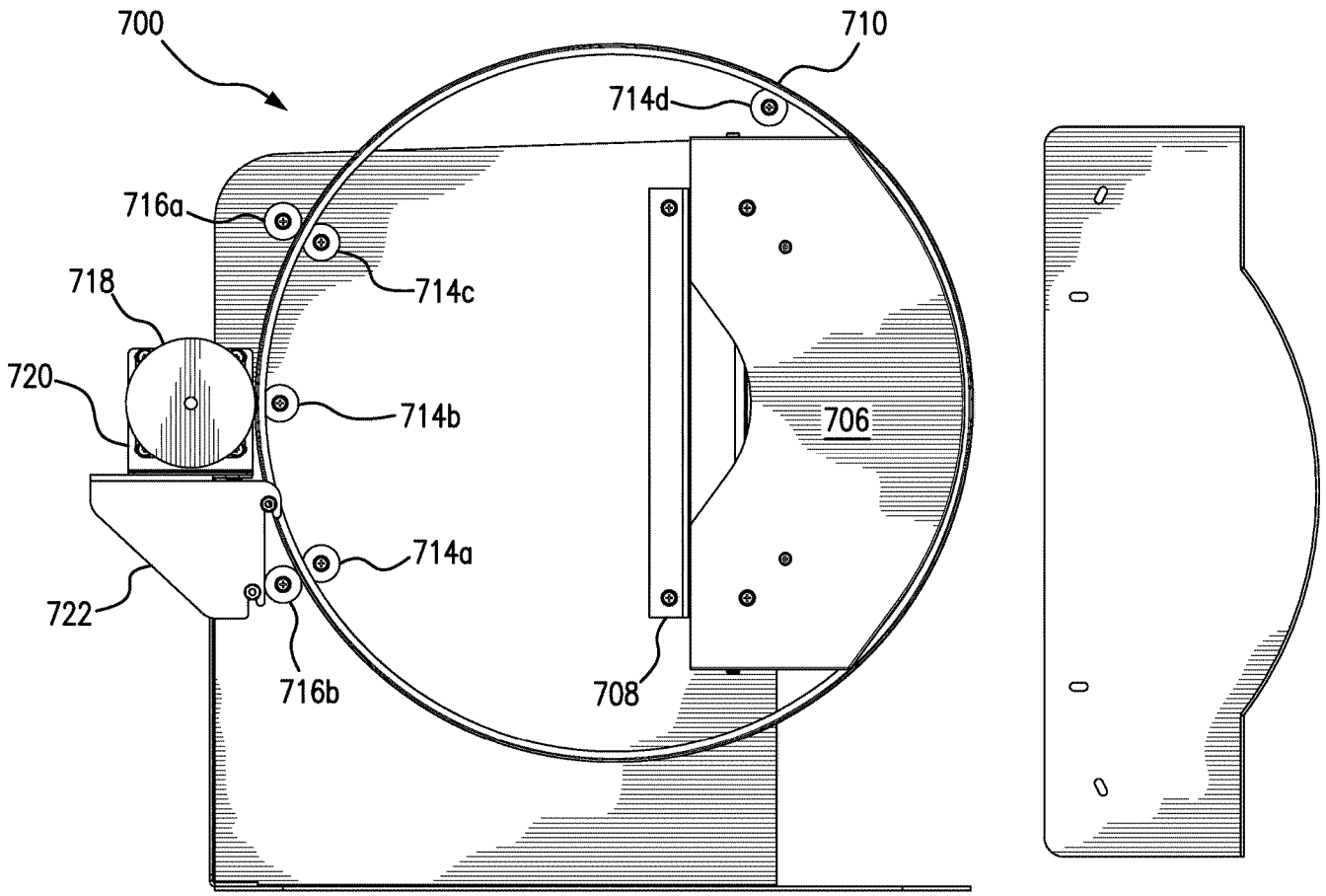
FIG. 7 shows a lateral view of an embodiment of an assembly similar to that shown in FIG. 4.

FIG. 7 shows a lateral view of components of an assembly 700 similar to that shown in FIGS. 4 and 5. A housing 706 to house electronics and a housing bracket 708 are provided within a mechanical reel 710. The mechanical reel is shown touching a set of internal mounts 714*a*-714*d* and a set of external mounts 716*a*-716*b*, which are rotatable mounts similar to the internal mounts 514*a*-514*i* and external mounts 516*a* and 516*b* described for FIG. 5. As can be appreciated from FIG. 7, these mounts are positioned and oriented to allow the mechanical reel 710 to rotate about a central axis without the need for or providing a physical central axis. Further, the mounts 714*a*-714*d* and 716*a*-716*b* are oriented to maintain the position of the mechanical wheel 710, relative to the other components of the assembly.

Drive wheel 718 is rotatably attached to drive motor 720 and drive motor 720 is mounted to support brace 722. The drive wheel touches and frictionally engages the mechanical reel 710 such that when the drive motor 720 turns the drive wheel 718, the mechanical reel 710 rotates in a direction opposite the rotational direction of the drive wheel 718. In the particular embodiment shown, the drive wheel 718 and drive motor 720 are mounted externally to the mechanical reel 710 and the drive wheel 718 engages the outer surface of the mechanical reel.

Figure 8:
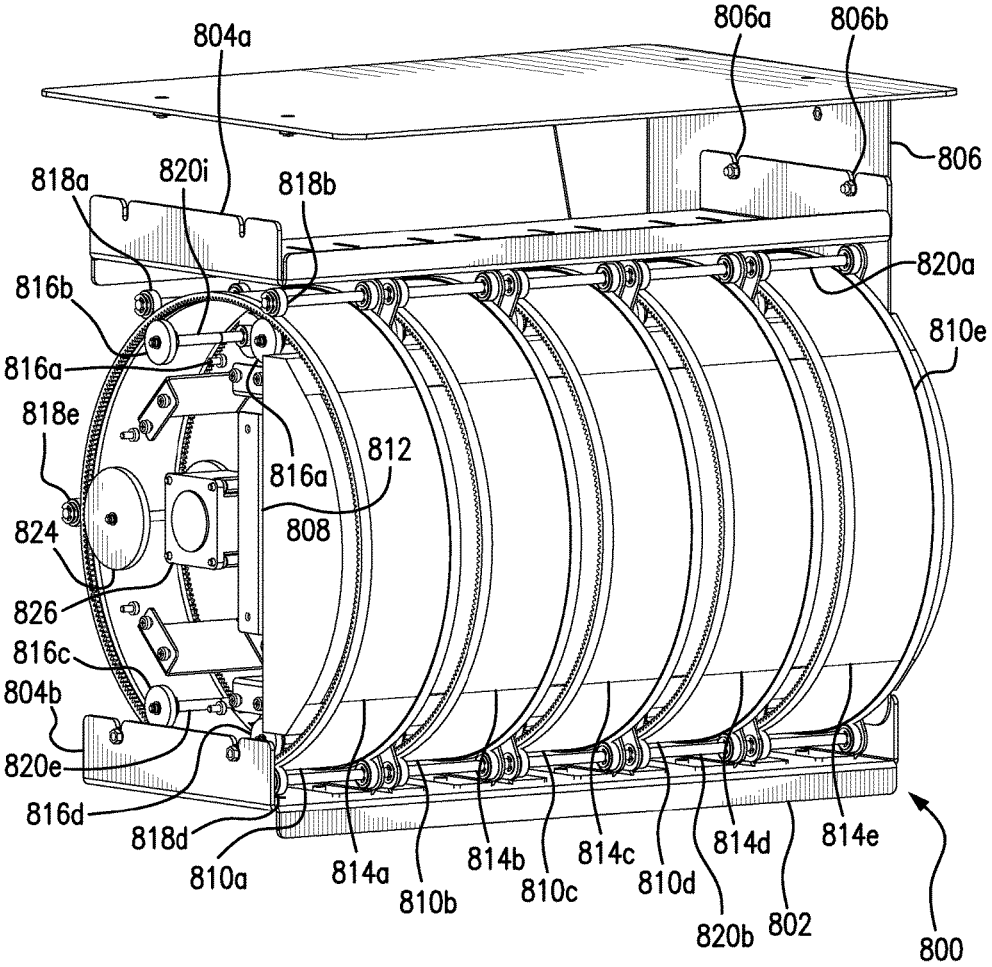
FIG. 8 shows a perspective view of an assembly of mechanical reels in accordance with another embodiment.
Figure 9:
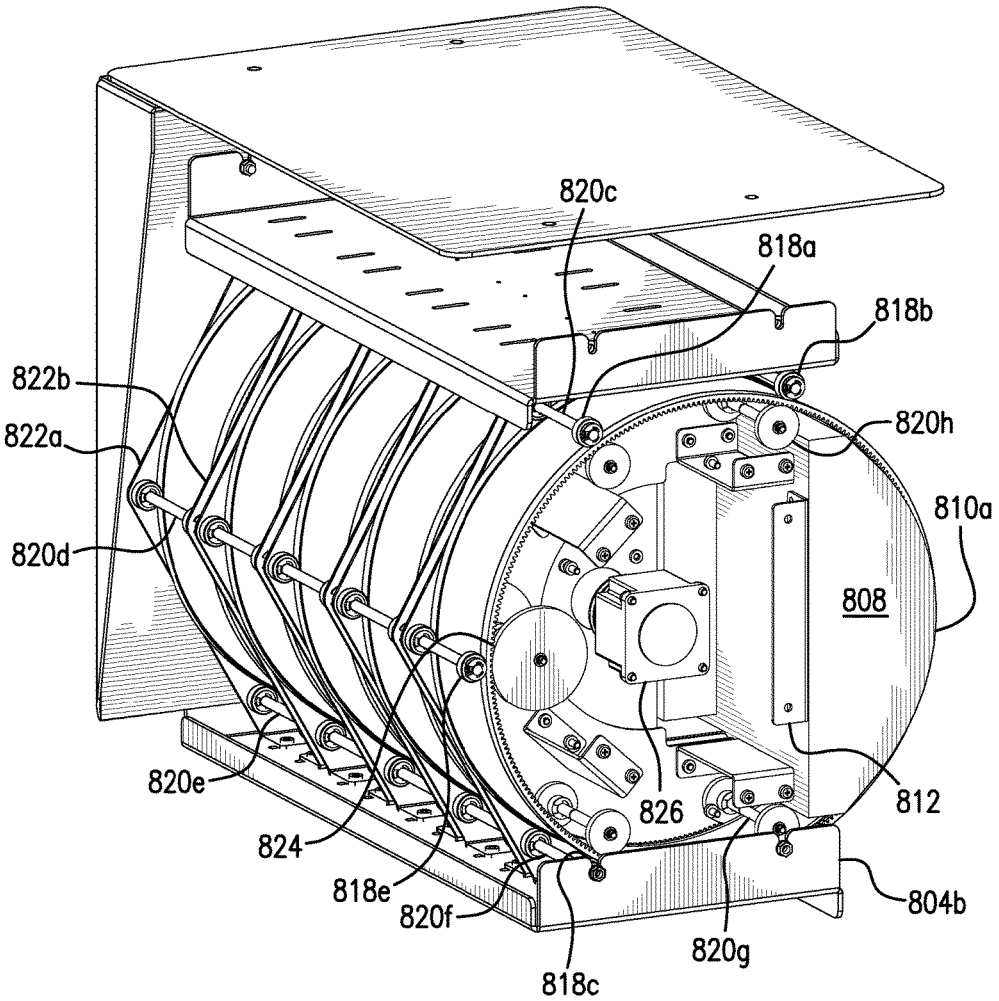
FIG. 9 shows a perspective view of an assembly of mechanical reels similar to that shown in FIG. 8.

FIGS. 8 and 9 depict perspective views of an assembly 800 of mechanical reels and related mounting hardware in accordance with another embodiment of the invention. Brackets 802 and 804*a* are mounted below and above the assembly 800 and engage a support panel 806. While support panel 806 is depicted on the right side of the assembly 800, it should be understood that a mirror image or other suitably arranged support panel (not shown) may be provided on the opposite side of the assembly 800. In FIGS. 8 and 9, this support panel (not shown) is removed to allow visualization of the internal components of the assembly 800.

Support panel 806 includes mounting holes or notches 806*a* and 806*b*, as well as other suitably positioned and fashioned mounting holes or notches (not shown) to engage corresponding mounting points or fixtures on the brackets 802 and 804*a*. A housing 808 is provided within mechanical reels 810*a*, 810*b*, 810*c*, 810*d*, and 810*e* to house electronics (not shown). The housing 808 also includes an L-bracket 812, which may, for instance, be configured to engage a support panel (not shown) similar to support panel 806. The electronics may be provided in housing 808 within the mechanical reels 810*a*, 810*b*, 810*c*, 810*d*, and 810*e* and are configured to cause the electronic displays 814*a*, 814*b*, 814*c*, 814*d*, and 814*e* to shown a variety of images or video. The electronic displays 814*a*, 814*b*, 814*c*, 814*d*, and 814*e* may be liquid crystal displays (LCDs) or organic light-emitting diode displays (OLEDs) or any other suitable electronic visual display apparatus for providing a video display. Preferably, the electronic displays 814*a*, 814*b*, 814*c*, 814*d*, and 814*e* are curved to generally match the curved outer surface of the mechanical reels 810*a*, 810*b*, 810*c*, 810*d*, and 810*e* so that, in this configuration, the curved outer surface of the mechanical reels 810*a*, 810*b*, 810*c*, 810*d*, and 810*e* is adjacent to and at a relatively close distance to the respective electronic display 814*a*, 814*b*, 814*c*, 814*d*, and 814*e*. In this context, close distance should be understood to mean within 0.5 inches, preferably within 0.3 inches and even more preferably within 0.2 inches and most preferably within 0.1 inches.

In an alternative embodiment (not shown), a single electronic display is provided and mounted within mechanical reels 810*a*, 810*b*, 810*c*, 810*d*, and 810*e*. In this configuration the single electronic display is of sufficient width to span the breadth of the set of mechanical reels 810*a*, 810*b*, 810*c*, 810*d*, and 810*e*. Preferably a plurality of images or videos are provided on the single electronic display, one for each of the mechanical reels 810*a*, 810*b*, 810*c*, 810*d*, and 810*e*. The plurality of images may be separated by frames, empty space of white or black or other suitable color or other separating features may be provided between the plurality of images.

In either the embodiment with a single electronic display or the embodiment with a plurality of electronic displays 814*a*, 814*b*, 814*c*, 814*d*, and 814*e*, as shown in FIGS. 8 and 9, noted previously, any different number of mechanical reels might be employed, and a similar or different number of electronic displays might be employed. For instance, in one embodiment (not shown) a single mechanical reel is provided.

Also shown in FIGS. 8 and 9 are a plurality of mounts including four internal mounts 816*a*-816*d* as well as five external mounts 818*a*-818*e*. The internal mounts 816*a*-816*d* and external mounts 818*a*-818*e* are configured and positioned to rotatably mount the mechanical reel 810*a*. A plurality of other internal and external mounts are similarly positioned with respect to each mechanical reel 810*b*, 810*c*, 810*d*, and 810*e* so that the mechanical reels 810*a*, 810*b*, 810*c*, 810*d*, and 810*e* are able to rotate about a common central axis extending linearly through the middle of the set of mechanical reels 810*a*, 810*b*, 810*c*, 810*d*, and 810*e*. In one embodiment this common central axis is not defined by any physical structure, as there is no central mounting rod or other hardware present at this common central axis. Instead, a series of mounting rods 820*a*, 820*b*, 820*c*, 820*d*, 820*e*, 820*f*, 820*g*, 820*h*, and 820*i* extend along separate axes that extend in parallel with the common central axis. As shown in FIGS. 8 and 9, mounting rods 820*a*, 820*b*, 820*c*, 820*d*, and 820*e* are mounted externally to the set of mechanical reels 810*a*, 810*b*, 810*c*, 810*d*, and 810*e*. FIGS. 8 and 9 also show mounting rods 820*f*, 820*g*, 820*h*, and 820*i* mounted externally, outside of the set of mechanical reels 810*a*, 810*b*, 810*c*, 810*d*, and 810*e*. it should be appreciated that additional or fewer internal and/or external mounting rods may be used and that the mounting rods may be positioned differently in relation to each other and to the mechanical reels.

In one embodiment, mounting rods 820*a*, 820*b*, 820*c*, 820*d*, 820*e*, 820*f*, 820*g*, 820*h*, and 820*i* extend across the width of the assembly, as shown for mounting rod 820*d*. Each individual mounting rod may be attached to respective mounting plates such as mounting plates 822*a* and 822*b*. In an alternative embodiment, one or more of the mounting rods may exist as a plurality of separate rods so that a collection of rods are used to span the breadth of the mechanical reels 810*a*, 810*b*, 810*c*, 810*d*, and 810*e*. In such an embodiment, each individual mounting rod may be attached to respective mounting plates such as mounting plates 822*a* and 822*b*.

As can be appreciated from FIGS. 8 and 9 together, mounting rod 820*e* extends between and is mounted to lateral support 804*b*. Similarly, the other mounting rods 820*a*, 820*b*, 820*c*, 820*d*, 820*e*, 820*f*, 820*g*, 820*h*, and 820*i* may also extend between and be mounted to lateral support such as support panel 806. In this way a plurality of rotatable mounts such as internal mounts 816*a*-816*d* and external mounts 818*a*-818*e* may be mounted on the mounting rods and rotate upon the same axis as the respective mounting rod upon which they are provided. Each of the mechanical reels 510*a*, 510*b*, 510*c*, 510*d*, and 510*e* is provided with a set of these rotatable mounts which provide rotatable support for the respective mechanical reel.

Each of the internal mounts 816*a*-816*d* and external mounts 818*a*-818*e* are rotatably mounted to the respective mounting rod. Accordingly, the internal mounts 816*a*-816*d* and external mounts 818*a*-818*e* may be provided in the form of cylindrical roller bearings, idle rollers or other suitable rollers capable of touching and rotating in conjunction with the rotation of the mechanical reels, as described above.

In a preferred embodiment, the set of mechanical reels 810*a*, 810*b*, 810*c*, 810*d*, and 810*e* are independently mounted so that each mechanical reel can rotate independently of the other mechanical reels. Although the embodiments described herein include five mechanical reels, it should be appreciated that the concepts described herein embrace any number of mechanical reels, including addition mechanical reels or fewer mechanical reels, even as few a one mechanical reel.

FIGS. 8 and 9 also show drive wheel 824 mounted arranged to be driven by drive motor 826 that is mounted within mechanical reel 810*a*. Each mechanical reel 810*a*, 810*b*, 810*c*, 810*d*, and 810*e* may be provided with its own dedicated and independent drive wheel and drive motor assembly. The drive motors may cause the drive wheels to turn by direct mechanical engagement, for instance by gears having teeth, or by indirect engagement, for instance with chains, belts, straps, pulleys or a combination of the foregoing. Optionally, the drive wheels and drive motors may be configured to have a direct frictional engagement. In a preferred embodiment the drive motors are stepper motors where the rotational speed of the drive motor can be controlled, for instance with a drive motor controller including a processor. The drive motors may be provided with one or more driving disks (not shown) which configured to transfer the rotational force generated by the motor. In one embodiment, each driving motor is provided with two such driving disks.

Figure 10:
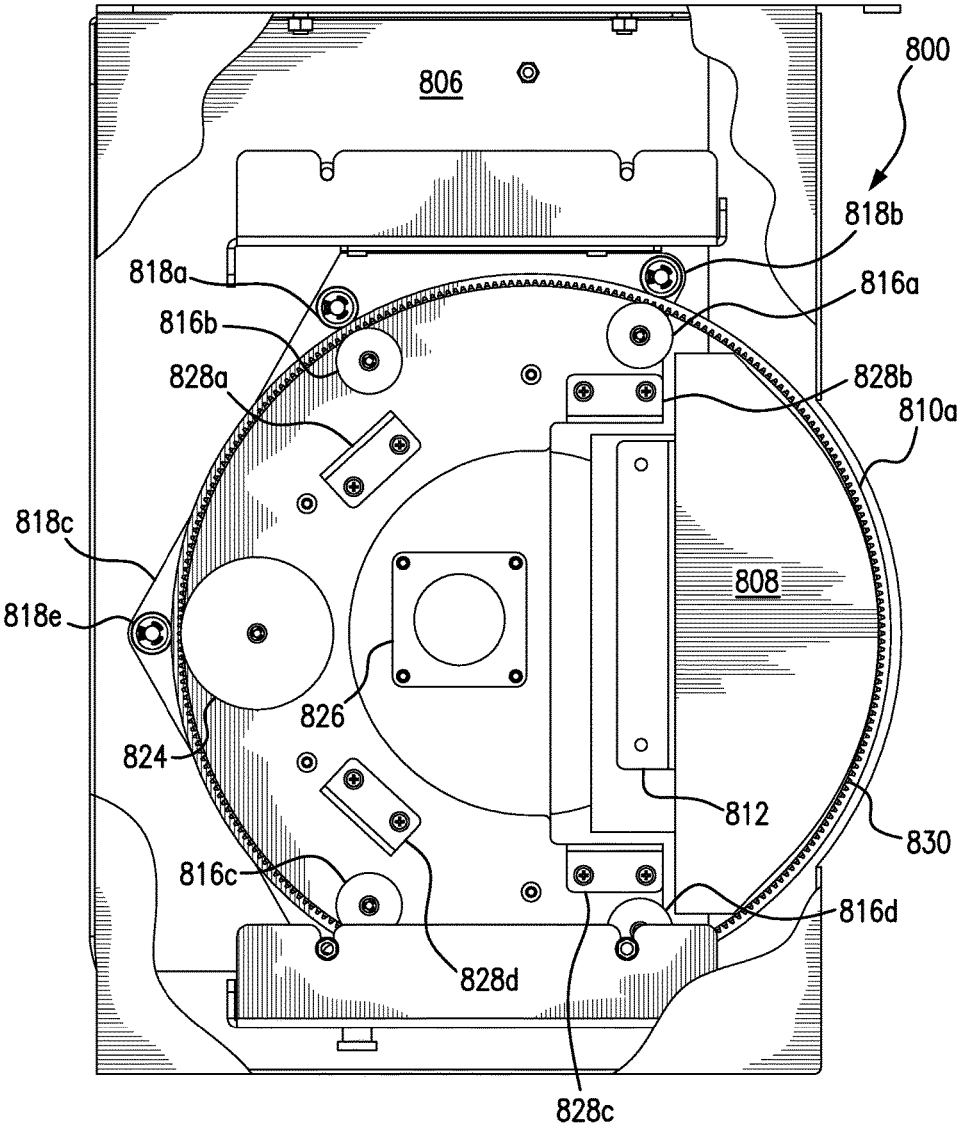
FIG. 10 shows a perspective view of an assembly of mechanical reels similar to that shown in FIG. 8.

FIG. 10 shows a lateral view of an assembly 800 in accordance with an embodiment of the invention similar to that shown in FIGS. 8 and 9. A housing 808 to house electronics is shown and the housing 808 also includes an L-bracket 812, which may, for instance, be configured to engage a support panel (not shown) similar to support panel 806. The mechanical reel is shown touching and supported by a set of internal mounts 816*a*-816*d* as well as several external mounts 818*a*, 818*b*, and 818*e*. Additional mounts are not visible in FIG. 10. These internal and external mounts are rotatable mounts similar to the internal mounts 514*a*-514*i* and external mounts 516*a* and 516*b* described for FIG. 5. As can be appreciated from FIG. 10, these mounts are positioned and oriented to allow the mechanical reel 810*a* to rotate about a central axis without the need for or providing a physical central axis. Further, the mounts are oriented to maintain the position of the mechanical wheel 810*a*, relative to the other components of the assembly.

Drive wheel 824 is rotatably engaged with drive motor 826 so that the drive motor 826 can apply a rotatable force to drive wheel 824. In the embodiment shown, the drive wheel 824 touches and frictionally engages the mechanical reel 810*a* such that when the drive motor 826 turns the drive wheel 824, the mechanical reel 810*a* rotates in a direction opposite the rotational direction of the drive wheel 824. In the particular embodiment shown, the drive wheel 824 and drive motor 826 are mounted internally, within the mechanical reel 810*a* and the drive wheel 824 engages the inner surface of the mechanical reel 810*a*.

FIG. 10 also depicts mounts 828*a*, 828*b*, 828*c*, and 828*d* that are positioned internally within the mechanical reel 810*a* in a way that they can engage and be mounted to mounting plates such as mounting plate 822*c*. As such, a series of mounts such as mounts 828*a*, 828*b*, 828*c*, and 828*d* attached to mounting plates such as mounting plate 822*c* can be repeated for each of the mechanical reels in a way that provides positioning and support for the assembly 800 and the components within the mechanical reels. In particular, several components within the mechanical reels, including, for instance, the housing 808 to house electronics, the drive wheel 824 and drive motor 826. Additionally, self-clinching standoffs (not shown) may be installed into the plates that hold the assembly 800 together so that each mechanical reel assembly attaches to the adjacent mechanical reel assembly. These standoffs could be provided in the form of small brackets, spacers, or other suitable hardware.

The particular embodiment of a mechanical reel 810*a* shown in FIG. 10 is depicted with a set of engagement teeth 830 on the interior of the mechanical. These teeth may be used, for instance, to engage the drive motor and/or mechanisms or other features that transfer force generated by the drive motor 826 to the mechanical reel 810*a*. In an alternative embodiment, the teeth may be provided on the external side of the mechanical reel 810*a*, for instance in an embodiment such as that described above where the drive motor 720 is external to the mechanical reel 710.

In certain aspects, methods and systems are provided for providing game play on an apparatus such as described above. In one such embodiment, each mechanical reel strip is provided with slot machine symbols printed thereon or otherwise affixed thereto.

In response to a play by a game player, the mechanical reels are caused to start spinning and the video reels are turned off or otherwise provide a blank or background image.

The mechanical reels are stopped to a predetermined location (for instance, as specified by a random number generator) in association with additional symbols that are projected onto or otherwise visible through the mechanical reels by way of the video reels.

The video reels may thus be used to display additional symbols, images, or animations or to modify a symbol on the mechanical reel or to show additional symbols, images, or animations.

In an alternative embodiment, rather than turning off the video reels during spinning, the images shown on the video displays may be coordinated with the spinning motion and rotational velocity of the mechanical reels so that the images shown on the video displays and the physical mechanical reels appear to be synchronized.

In another embodiment relating to aspects of methods and systems for providing game play on an apparatus such as described above, the movement of the images on the video displays and the rotation of the mechanical reels are synchronized by driving the rotation of the mechanical reels at the same speed and acceleration or deceleration as the scrolling movement of the images on the video displays. Optical, mechanical or other feedback mechanisms may provide feedback including data or information on the speed and/or position of the mechanical reel. Additionally, bouncing, vibrating and wobbling of the mechanical reels may be simulated with the images provided on the video displays.

In another embodiment relating to aspects of methods and systems for game play on an apparatus such as described above, the steps of an exemplary method for providing game play are provided.

In one method, the game play begins with the player hitting a play button or pulling a lever, thereby causing the game machine to receive a initiate game input indicating a player's desire to play a game.

In response to receipt of this initiate game input, the game software and the processor uses a random number generator to determine the game outcome corresponding to a particular positions on the reels (which defines the reels stop positions). Alternatively, the game software and processor may retrieve a predetermined or randomly determined game output from a networked game machine controller.

The game software and the processor then causes the video displays to begin displaying scrolling video slot machine symbols. Simultaneously with the video display, the game software and the processor causes the motors within the mechanical reel assembly to drive the rotation of the mechanical reels, preferably at a speed and acceleration or deceleration that is coordinated with the rotation of the respective video display for each mechanical reel. In this way, the movement of each mechanical reel appears to be synchronized with the apparent movement of the images on the respective video display. The resulting appearance to the game player simulates the spinning mechanical reels of a traditional slot machine, however, using the ability to simulate motion with the video display screens, for instance, showing slot machine symbols scrolling in a vertical direction, from top to bottom.

After spinning for a predetermined or random amount of time, the software and the processor cause the mechanical reels to stop and the slowing down and stopping of the mechanical reels is synchronized to match the slowing down and stopping of the apparent movement of the images on the video display screens. In one embodiment, the mechanical reels and display images stop in a predetermined order, for instance starting with the left-most mechanical reel and continuing from left to right. Preferably, each mechanical reel and the respective video display will stop at the same time.

At this point, the images displayed on the video reels show the player the stopped position of the virtual reels (the virtual reel being the combination of the video display and the associated images along with the mechanical reel).

The processor controls the stopped position of the virtual reels, including the images appearing on each video display and this result shown will correspond to the predetermined or randomly determined outcome for the game. If this game outcome is a winning combination, the available credits for the game player will be updated accordingly.

In normal operation a video display and the corresponding mechanical reel will start spinning at the same time, at the same speed and will accelerate or decelerate and both stop at the same time. This coordinated and synchronized movement of the video display and the corresponding mechanical reel together, can provide the game player a visual effect that simulates a single traditional mechanical reel. At the same, the game developer and operator is afforded options and flexibility that are not present with traditional mechanical reels. Moreover, the game operator and game developer are not constrained to coordinating and synchronizing the movement of the mechanical reel with the apparent movement of the images on the video screen and the concepts provided herein allow for interesting and entertaining game play presentations for the play.

Additionally, a feedback circuit may be provided to provide information about the actual speed of the mechanical reel, and, the processor receives speed data or other information and detects that the mechanical reel is spinning too quickly or too slowly, the processor may adjust the rotational speed of the drive motor, and thereby the spinning speed of the mechanical reel. In certain preferred embodiment, the processor adjusts the speed of the corresponding mechanical reel such that the speed of the mechanical reel and images being displayed on the video reel are the same. This can be useful, for instance, if there is a mechanical or other problem that might unexpectedly increase or decrease the speed of the mechanical reel.

Additionally, in the event of a malfunction with a video display, for instance if the apparent movement of the images on the video display stops, the processor may cause the drive motor to stop the corresponding mechanical reel. Similarly, if a mechanical reel stops spinning, the processor may stop the corresponding video reel. Still further, in certain types of game play, the player may provide an instruction to stop one or more of the reels and, upon receipt of this instruction, the processor will cause both the video and mechanical reels stop, preferably simultaneously. As described above, optical, electronic, or mechanical feedback may be used to provide feedback data and information on the speed as well as position of the mechanical reels.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The following embodiments are disclosed in the context of the present invention:

1. A gaming machine configured to provide a wagering game and providing a payout based on the wager and the results of the game, comprising:

a plurality of disk-shaped cylindrical mechanical reels each provided with a drive mechanism to control rotation of the mechanical reel independent of the rotation of the other mechanical reels and each mechanical reel having a transparent curved outer surface;

a plurality of electronic video displays each having a convex curved display surface, wherein one video display is fixedly mounted internally within each mechanical reel so that the mechanical reel rotates around the video display and the convex curved display surface of the video display is adjacent to and visible through the curved surface of the mechanical reel;

a controller to synchronize each drive mechanism and the rotation of each mechanical reel with images presented on the respective video display mounted within each mechanical reel so that the images shown on the video display appear to move in synchronization with the rotation of the mechanical reel.

2. The gaming machine of embodiment 1, wherein the controller is configured to receive an input indicating the rotational speed of a mechanical reel and to adjust the presentation of the images on the video display within that mechanical reel accordingly.

3. The gaming machine of embodiment 1 or 2, wherein the controller is configured to receive an input indicating the rotational speed of a mechanical reel and to adjust the speed of that mechanical reel accordingly.

4. The gaming machine of any of the preceding embodiments, wherein the curved display surface of the video display is not concentric to the curved surface of the mechanical reel.

5. The gaming machine of any of the preceding embodiments, wherein each mechanical reel is rotatably mounted to a plurality of internal mounts within each wheel.

6. The gaming machine of any of the preceding embodiments, wherein each mechanical reel is rotatably mounted to a plurality of external mounts for each wheel 7. The gaming machine of any of the preceding embodiments, further comprising a processor configured to cause each video display to provide a visual simulation of a mechanical spinning slot machine reel.

8. The gaming machine of any of the preceding embodiments, wherein the mechanical reels do not have spokes and are not affixed about a central axis.

9. The gaming machine of any of the preceding embodiments, wherein each drive mechanism is a stepper motor configured to mechanically or frictionally engage the mechanical reel and drive the rotation of the mechanical reel.

10. The gaming machine of embodiment 9, wherein the stepper motor includes a drive wheel to contact the mechanical wheel at the point of contact.

11. The gaming machine of any of the preceding embodiments, wherein each mechanical reel comprises a pair of circular hoops attached to adjacent sides of a strip of transparent material, the transparent material forming the transparent curved outer surface of the mechanical reel.

12. The gaming machine of embodiment 11, wherein one or both of the hoops are configured with guides to maintain contact between the hoops and the roller and avoid the hoops slipping off the rollers.

13. The gaming machine of any of embodiments 5 to 12, wherein the mounts comprise multiple pairs of roller bearings or idle rollers.

14. The gaming machine of any of the preceding embodiments, further comprising markings on the transparent curved outer surface of the mechanical reel that simulate the appearance of mechanical reels.

15. An assembly for a gaming machine configured to simulate the appearance of a plurality of slot machine reels, the assembly comprising:

a plurality of mechanical cylinders, each cylinder defined by adjacent circular rings and each cylinder having a transparent curved outer surface defined by a transparent band disposed between the adjacent circular rings, each mechanical cylinder being rotatably mounted to a plurality of mounts disposed to support at least one of the circular rings, each mechanical cylinder having an individual drive mechanism configured to independently control the rotation of the mechanical cylinder separate from the rotation of the other mechanical cylinder;

a plurality of electronic video displays each having a convex curved display surface for presenting a visual simulation of a mechanical spinning slot machine reel, wherein one video display is fixedly mounted internally within each mechanical cylinder so that the mechanical cylinder rotates around the fixedly mounted video display and the convex curved display surface of the video display is adjacent to and visible through the curved outer surface of the respective mechanical cylinder; and a controller configured to synchronize the drive mechanisms and the rotation of each mechanical cylinder with the images presented on the respective video display mounted within that mechanical cylinder so that the images shown on the video display appear to move in accordance with the rotation of the mechanical cylinder.

16. A component for a gaming machine configured to provide a wagering game, the component comprising:

a disk-shaped cylindrical mechanical reel having a curved outer surface and being provided with a drive mechanism to control rotation of the mechanical reel; and an electronic video display having a display surface, the video display being fixedly mounted internally within the mechanical reel so that the mechanical reel rotates around the video display and the display surface of the video display is adjacent to and visible through the curved surface of the mechanical reel.

17. The component of embodiment 16, wherein the curved outer surface of the mechanical reel is transparent.

18. A method of presenting a result in a wagering game to a player, the method comprising:

accelerating the rotational speed of a simulated mechanical slot machine reel appearing on an electronic video display and then slowing the rotational speed down to a stopped position while simultaneously matching the rotational speed of a mechanical cylinder coaxially mounted around the electronic video display to the rotational speed of a simulated mechanical slot machine reel appearing on an electronic video display by accelerating the rotational speed of the mechanical cylinder and then slowing the rotational speed of the mechanical cylinder.

19. The method of embodiment 18, further comprising adjusting the rotational speed of the mechanical cylinder based on rotational speed information related to the images being shown on the video display.

20. The method of embodiment 18 or 19, further comprising adjusting the rotational speed of images being shown on the video display based on rotational speed information related to the mechanical cylinder.

What is claimed is:

1. A gaming machine configured to provide a wagering game and providing a payout based on the wager and the results of the game, comprising:

a plurality of disk-shaped cylindrical mechanical reels each provided with a drive mechanism configured to control rotation of the mechanical reel independent of the rotation of the other mechanical reels and each mechanical reel having a transparent curved outer surface, wherein each mechanical reel comprises a pair of rigid circular hoops attached to adjacent sides of a strip of transparent material, the transparent material forming the transparent curved outer surface of the mechanical reel;

a plurality of electronic video displays each having a convex curved display surface, wherein one video display is fixedly mounted internally within each mechanical reel so that the mechanical reel is configured to rotate about an axis of rotation around the video display and the convex curved display surface of the video display is adjacent to and visible through the curved surface of the mechanical reel;

a plurality of pairs of roller mounts, wherein for each pair of roller mounts:

one mechanical reel is rotatably mounted to the pair of roller mounts, one rigid circular hoop of the pair of rigid circular hoops is adjacent to one roller mount of the pair of roller mounts to discourage movement of the mechanical reel in a first direction parallel to the axis of rotation, and the other rigid circular hoop of the pair of rigid circular hoops is adjacent to the other roller mount of the pair of roller mounts to discourage movement of the mechanical reel in a second direction parallel to the axis of rotation, the second direction opposite the first direction;

wherein each of the roller mounts comprises an internal roller positioned against an inside surface of a corresponding rigid circular hoop and an external roller positioned against an outside surface of the corresponding rigid circular hoop directly opposite the internal roller;

wherein each of the internal rollers in a pair of roller mounts are connected by a first mounting rod and rotate about an axis of the first mounting rod, and each of the external rollers in a pair of roller mounts are connected by a second mounting rod and rotate about an axis of the second mounting rod; and a controller configured to synchronize each drive mechanism and the rotation of each mechanical reel with images presented on the respective video display mounted within each mechanical reel so that movement of the images shown on the video display appears to be synchronized with the rotation of the mechanical reel.

2. The gaming machine of claim 1, wherein the controller is configured to receive an input indicating the rotational speed of a mechanical reel and to adjust the presentation of the images on the video display within that mechanical reel accordingly.

3. The gaming machine of claim 1, wherein the controller is configured to receive an input indicating the rotational speed of a mechanical reel and to adjust the speed of that mechanical reel accordingly.

4. The gaming machine of claim 1, wherein the curved display surface of the video display is not concentric to the curved surface of the mechanical reel.

5. The gaming machine of claim 1, further comprising a processor configured to cause each video display to provide a visual simulation of a mechanical spinning slot machine reel.

6. The gaming machine of claim 1, wherein the mechanical reels do not have spokes and are not affixed about a central axis.

7. The gaming machine of claim 1, wherein each drive mechanism is a stepper motor configured to mechanically or frictionally engage the mechanical reel and drive the rotation of the mechanical reel.

8. The gaming machine of claim 7, wherein the stepper motor includes a drive wheel to contact the mechanical wheel at the point of contact.

9. The gaming machine of claim 1, wherein one or both of the rigid circular hoops are configured with guides to maintain contact between the rigid circular hoops and the internal rollers and to discourage the rigid circular hoops from slipping off the internal rollers.

10. The gaming machine of claim 1, wherein each pair of roller mounts comprises one of a pair of roller bearings or a pair of idle rollers.

11. The gaming machine of claim 1, further comprising markings on the transparent curved outer surface of the mechanical reel that simulate the appearance of mechanical reels.

12. An assembly for a gaming machine configured to simulate the appearance of a plurality of slot machine reels, the assembly comprising:

a plurality of mechanical cylinders, each cylinder defined by adjacent rigid circular rings and each cylinder having a transparent curved outer surface defined by a transparent band disposed between the adjacent rigid circular rings, each mechanical cylinder being rotatably mounted to a plurality of mounts disposed to support at least one of the rigid circular rings, each mechanical cylinder having an individual drive mechanism configured to independently control the rotation of the mechanical cylinder about a common axis of rotation separate from the rotation of the other mechanical cylinder;

a plurality of electronic video displays each having a convex curved display surface for presenting a visual simulation of a mechanical spinning slot machine reel, wherein one video display is fixedly mounted internally within each mechanical cylinder so that the mechanical cylinder rotates around the fixedly mounted video display and the convex curved display surface of the video display is adjacent to and visible through the curved outer surface of the respective mechanical cylinder;

a plurality of pairs of roller mounts, wherein for each pair of roller mounts:

one mechanical cylinder is rotatably mounted to the pair of roller mounts, one rigid circular ring of the pair of rigid circular rings is adjacent to one roller mount of the pair of roller mounts to discourage movement of the mechanical cylinder in a first direction parallel to the axis of rotation, and the other rigid circular ring of the pair of rigid circular rings is adjacent to the other roller mount of the pair of roller mounts to discourage movement of the mechanical cylinder in a second direction parallel to the axis of rotation, the second direction opposite the first direction;

wherein each of the roller mounts comprises an internal roller positioned against an inside surface of a corresponding rigid circular ring and an external roller positioned against an outside surface of the corresponding rigid circular ring directly opposite the internal roller;

wherein each of the internal rollers in a pair of roller mounts are connected by a first mounting rod and rotate about an axis of the first mounting rod, and each of the external rollers in a pair of roller mounts are connected by a second mounting rod and rotate about an axis of the second mounting rod; and a controller configured to synchronize the drive mechanisms and the rotation of each mechanical cylinder with the images presented on the respective video display mounted within that mechanical cylinder so that the images shown on the video display appears to move in synchronization with the rotation of the mechanical cylinder.

13. A component for a gaming machine configured to provide a wagering game, the component comprising:

a disk-shaped cylindrical mechanical reel having a curved outer surface and being provided with a drive mechanism to control rotation of the mechanical reel, wherein the mechanical reel comprises a pair of rigid circular hoops attached to adjacent sides of a strip of transparent material, the transparent material forming the curved outer surface of the mechanical reel;

an electronic video display having a display surface, the video display being fixedly mounted internally within the mechanical reel so that the mechanical reel rotates around the video display and the display surface of the video display is adjacent to and visible through the curved surface of the mechanical reel; and a pairs of roller mounts, wherein the mechanical reel is rotatably mounted to the pair of roller mounts, wherein one rigid circular hoop of the pair of rigid circular hoops is adjacent to one roller mount of the pair of roller mounts to discourage movement of the mechanical reel in a first direction parallel to the axis of rotation, wherein the other rigid circular hoop of the pair of rigid circular hoops is adjacent to the other roller mount of the pair of roller mounts to discourage movement of the mechanical reel in a second direction parallel to the axis of rotation, the second direction opposite the first direction;

wherein each of the roller mounts comprises an internal roller positioned against an inside surface of a corresponding rigid circular hoop and an external roller positioned against an outside surface of the corresponding rigid circular hoop directly opposite the internal roller; and wherein each of the internal rollers in a pair of roller mounts are connected by a first mounting rod and rotate about an axis of the first mounting rod, and each of the external rollers in a pair of roller mounts are connected by a second mounting rod and rotate about an axis of the second mounting rod.

14. The component of claim 13, wherein the curved outer surface of the mechanical reel is transparent.

* * * * *